US005494613A

United States Patent [19]

Rush, II et al.

[11] Patent Number: 5,494,613

[45] Date of Patent: Feb. 27, 1996

[54] CARBURETOR WITH ENRICHMENT FUEL PUMP

[75] Inventors: William B. Rush, II, Antioch; Mark A. Walter, Round Lake Beach, both of Ill.; Henry C. Billingsley, Kenosha, Wis.

[73] Assignee: Outboard Marine Corporation, Waukegan, Ill.

[21] Appl. No.: 318,364

[22] Filed: Oct. 5, 1994

Related U.S. Application Data

[63] Continuation-in-part of Ser. No. 130,633, Oct. 1, 1993.

[51] Int. Cl.[6] ..... F02M 7/093

[52] U.S. Cl. ..... 261/34.2

[58] Field of Search ..... 261/34.2

[56] References Cited

U.S. PATENT DOCUMENTS

| | | | |
|---|---|---|---|
| 2,389,922 | 11/1945 | Mennesson | 261/34.2 |
| 2,551,719 | 5/1951 | Ball | 261/34.2 |
| 3,086,757 | 4/1963 | Smith | 261/34.2 |
| 3,249,345 | 5/1966 | Gast | 261/39 |
| 3,689,036 | 9/1972 | Kikuchi et al. | 261/34.2 |
| 3,706,444 | 12/1972 | Masaki et al. | 261/39 D |
| 3,780,718 | 12/1973 | Nambu et al. | 123/179 G |
| 4,069,802 | 1/1978 | Ross | 123/179 G |
| 4,076,770 | 2/1978 | Saito et al. | 261/34.2 |

FOREIGN PATENT DOCUMENTS

| | | | |
|---|---|---|---|
| 1532732 | 2/1977 | France . | |
| 0603296 | 6/1948 | United Kingdom | 261/34.2 |

*Primary Examiner*—Tim R. Miles

*Attorney, Agent, or Firm*—Michael, Best & Friedrich

[57] ABSTRACT

Disclosed herein is a carburetor including a member defining an air induction passage including a downstream portion, an upstream portion, and a venturi located between the downstream portion and the upstream portion, a member defining a fuel chamber, a fuel well located in the air induction passage defining member, extending in the fuel chamber, and communicating with the fuel chamber, a high speed nozzle located in the fuel well and communicating with the venturi, and an enrichment fuel pump including a cover fixed to the fuel chamber defining member, a diaphragm located between the cover and the fuel chamber defining member and defining a fuel pumping chamber and a variable pressure chamber, a duct communicating between the variable pressure chamber and the downstream portion of the air induction passage downstream of the throttle valve, an inlet conduit communicating between the fuel chamber and the fuel pumping chamber and including an inlet check valve permitting in-flow into the fuel pumping chamber and preventing out-flow therefrom, and an outlet conduit communicating between the fuel pumping chamber and the fuel well and including an outlet check valve permitting out-flow from the fuel pumping chamber and preventing in-flow thereto.

5 Claims, 2 Drawing Sheets

21
43
13
17
19
41
83
23
15
37
25
29
57
27
55
33
51
31
93
35
99
91
53
95
103
101
97
100
11
60
59

51
53
111
117
119
110
131
133
115
113
135
59
67
73
63
69
71
61
75
77

81
61
63

CARBURETOR WITH ENRICHMENT FUEL PUMP

RELATED APPLICATION

This application is a continuation-in-part of application Ser. No. 08/130,633, filed Oct. 1, 1993 which is incorporated herein by reference.

BACKGROUND OF THE INVENTION

The invention relates generally to carburetors and, more particularly, to carburetors with fuel enrichment pumps.

SUMMARY OF THE INVENTION

The invention provides a carburetor including a member defining an air induction passage including a downstream portion, an upstream portion, and a venturi located between the downstream portion and the upstream portion, a member defining a fuel chamber, a fuel well located in the air induction passage defining member, extending in the fuel chamber, and communicating with the fuel chamber, a high speed nozzle located in the fuel well and communicating with the venturi, and an enrichment fuel pump including a cover fixed to the fuel chamber defining member, a diaphragm located between the cover and the fuel chamber defining member and defining a fuel pumping chamber and a variable pressure chamber, a duct communicating between the variable pressure chamber and the downstream portion of the air induction passage downstream of the throttle valve, an inlet conduit communicating between the fuel chamber and the fuel pumping chamber and including an inlet check valve permitting in-flow into the fuel pumping chamber and preventing out-flow therefrom, and an outlet conduit communicating between the fuel pumping chamber and the fuel well and including an outlet check valve permitting out-flow from the fuel pumping chamber and preventing in-flow thereto.

The invention also provides a carburetor including a member defining an air induction passage including a downstream portion, an upstream portion, and a venturi located between the downstream portion and the upstream portion, a member defining a fuel chamber, a fuel well located in the air induction passage defining member, extending in the fuel chamber, communicating with the fuel chamber, and including an open lower end, a high speed nozzle located in the fuel well and communicating with the venturi, and an enrichment fuel pump including a cover fixed to the fuel chamber defining member, a diaphragm located between the cover and the fuel chamber defining member and defining a fuel pumping chamber and a variable pressure chamber, a retainer plate located between the diaphragm and the fuel chamber defining member and including therein an aperture, a duct communicating between the variable pressure chamber and the downstream portion of the air induction passage downstream of the throttle valve, an inlet conduit communicating between the fuel chamber and the fuel pumping chamber and including an inlet check valve permitting in-flow into the fuel pumping chamber, preventing out-flow therefrom, and including an inlet valve seat on the inlet conduit, and an inlet ball valve member moveable relative to the inlet valve seat between open and closed positions, a socket member located between the inlet ball valve member and the retainer plate and including a socket portion partially enclosing the inlet ball valve member, and a spring bearing between the socket member and the retainer plate to bias the socket member so as to locate the inlet ball valve member in the closed position, an outlet conduit communicating between the fuel pumping chamber and the fuel well and including an outlet check valve including an outlet valve seat on the outlet conduit and an outlet ball valve member moveable relative to the outlet valve seat between open and closed positions so as to permit out-flow from the fuel pumping chamber and so as to prevent in-flow thereto, and a member located between the fuel well and the outlet conduit and including a cross wall closing the lower end of the fuel well, and a downwardly depending skirt enclosing the outlet ball valve member.

Other features and advantages of the invention will become apparent to those skilled in the art upon review of the following detailed description, claims and drawings.

Figure 1:
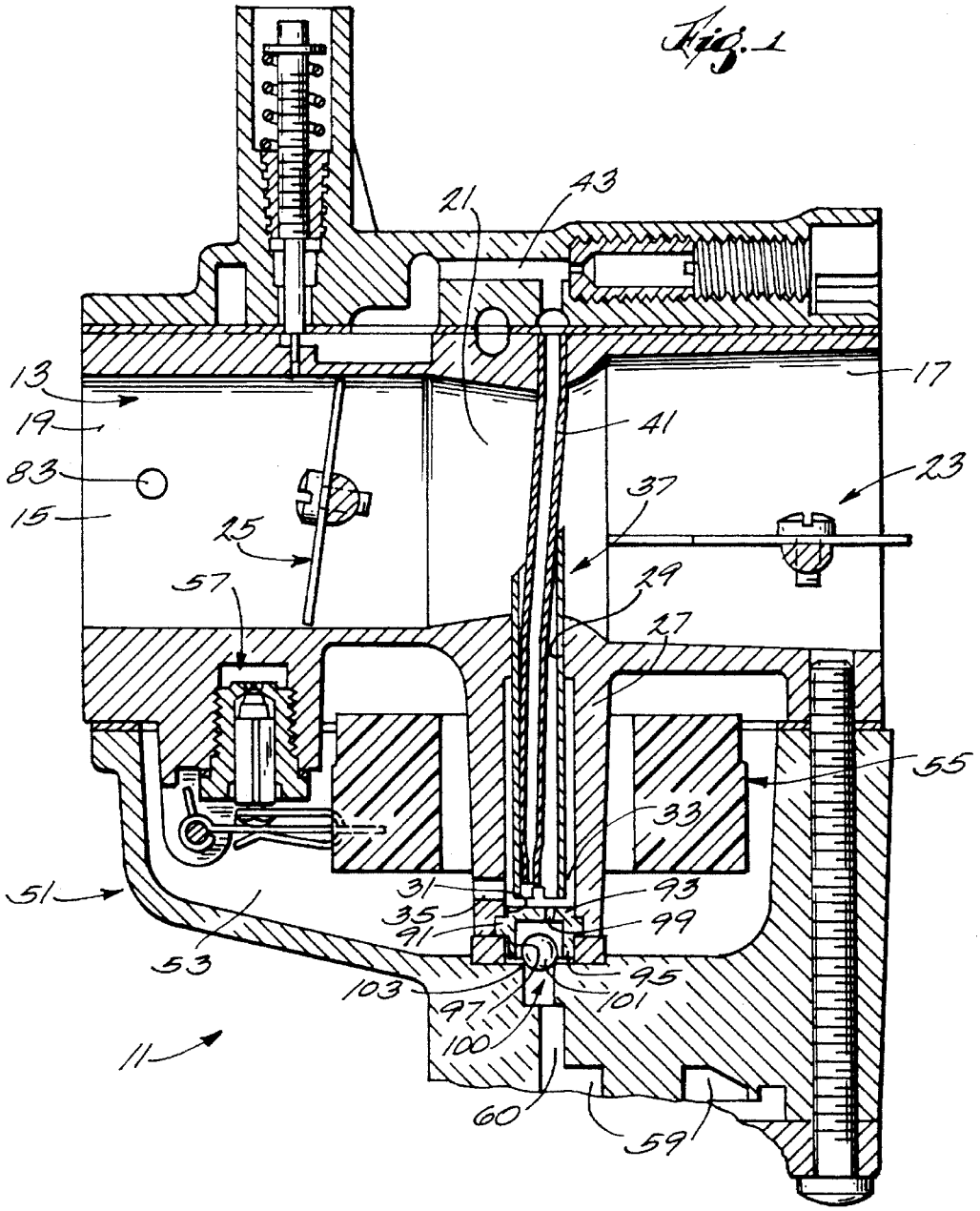
FIG. 1 is a fragmentary sectional view of a carbureator incorporating various of the features of the invention.

Before one embodiment of the invention is explained in detail, it is to be understood that the invention is not limited in its application to the details of the construction and the arrangements or components set forth in the following description or illustrated in the drawings. The invention is capable of other embodiments and of being practiced or being carried out in various ways. Also, it is to be understood that phraseology and terminology used herein is for the purpose of description and should not be regarded as limiting.

GENERAL DESCRIPTION

Illustrated in the drawings is a carburetor 11 comprising an air induction body or member 13 including wall means defining an air induction passage 15 including an upstream portion 17, a downstream portion 19, and a venturi 21 therebetween.

Pivotally mounted in the upstream portion 17 of the air induction passage 15 is a pivotally supported choke valve 23.

Pivotally mounted in the downstream portion 19 of the air induction passage 15 is a pivotally mounted throttle valve 25 which is moveable between open and closed positions. The air induction body or member 13 also includes a depending post or portion 27 having therein an axial bore 29 which, at its upper end, communicates with the venturi 21, and which, at its lower end, has a counter bore 31 which defines a fuel well 33 which, near the bottom thereof, communicates with a transverse bore or opening 35 which, in turn, communicates with a fuel bowl or chamber (to be described hereinafter) to permit suction in the fuel well 33 to draw fuel thereinto from the fuel bowl or chamber.

Located in the fuel well 33 is a tubular high speed nozzle 37 which, at the bottom thereof, is open adjacent the bottom of the fuel well 33, and which, adjacent the top thereof, is in sealing engagement with the axial bore 29 and opens into the venturi 21.

Located in the high speed nozzle 37 is an idle speed pickup tube 41 which includes a lower open end adjacent the lower end of the high speed nozzle 37, which extends out of the upper open end of the high speed nozzle 37, and which, at the upper end thereof, communicates with an idle fuel supply passage 43 which, in turn, communicates with the air induction passage 15 in the area adjacent the closed position of the throttle valve 25.

The carburetor 11 also includes a fuel bowl or chamber body or member 51 which is suitably attached, as by screws (not shown) to the air induction body or member 13, and which, together with the air induction passage member 13, defines a fuel bowl or chamber 53 having the depending post 27 extending thereinto.

Pivotally mounted in the fuel bowl or chamber 53 is a float 55 which controls operation of a fuel inlet valve 57 which controls supply of fuel from a remote source to the fuel bowl or chamber 53.

As thus disclosed, the construction is well known in the art.

Figure 2:
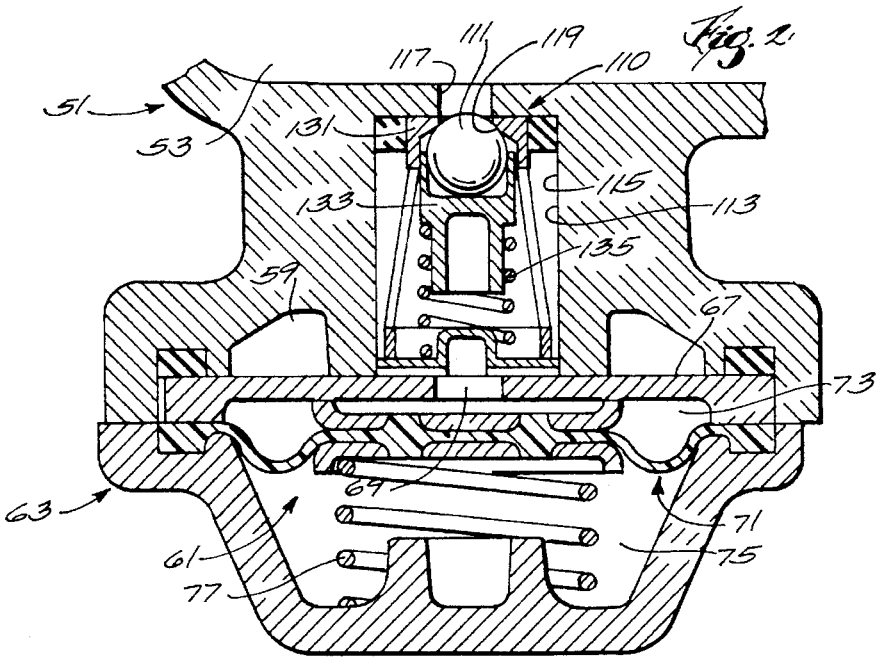
FIG. 2 is an enlarged sectional view of an enrichment fuel pump incorporated in the carbureator shown in FIG. 1.

Means are provided for supplying enrichment fuel to the venturi 21 through the high speed nozzle 37 in response to diminished suction accompanying rapid opening of the throttle valve 25. While other constructions can be employed, in the disclosed construction, such means comprises (see FIG. 2) a spring actuated and suction controlled fuel enrichment pump 61.

More specifically, the fuel enrichment pump 61 includes, on the lower surface of the fuel chamber member 51, an annular, ring-shaped well portion or recess 59 which communicates through an outlet conduit 60 with the fuel well 33. In addition, the fuel pump 61 also includes (see FIG. 2) an upwardly open, downwardly dished cover 63 which is suitably attached, as by screws (not shown), to the bottom of the fuel chamber member 51 in the area circumscribing the annular recess or well 59 and which, incident to such attachment, secures in place, between the fuel chamber member 51 and the cover 63, a retainer plate 67 including a central aperture 69.

Also secured in place incident to attachment of the cover 63 is a diaphragm 71 which is fabricated of flexible material, which is located below the retainer plate 67, and which defines an upper fuel pumping chamber 73 which includes the ring shaped recess 59 and which communicates through the aperature 69 with the recess 59, and a lower variable pressure chamber 75.

Located in the lower variable pressure chamber 75 within the cover 63, and between the cover 63 and the diaphragm 71, is a helical spring 77 which serves to bias upwardly the diaphragm 71 for delivery of fuel from the upper fuel pumping chamber 73, through the aperature 69, the ring shaped recess 59, and the outlet conduit 60 to the fuel well 33.

Figure 3:
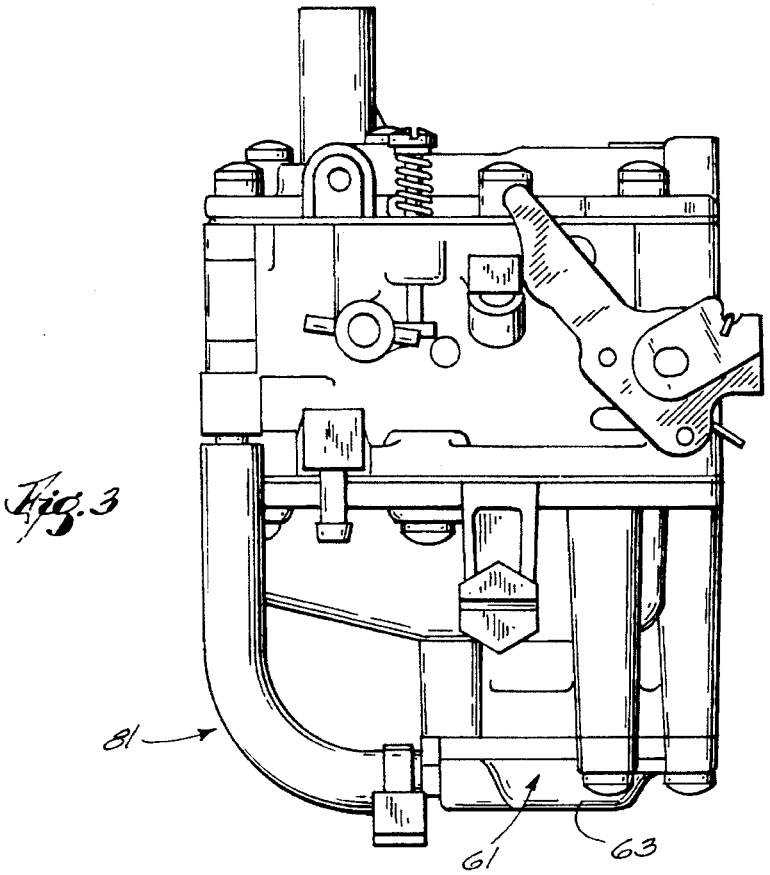
FIG. 3 is a an exterior view of the carbureator shown in FIG. 1.

The lower variable pressure chamber 75 communicates through (see FIG. 3) a suitable conduit or tube 81 with (see FIG. 1) a port 83 in the air induction passage 15 downstream of the throttle valve 25. As a consequence, when there is relatively large suction at the downstream end of the air induction passage 15 (i.e. when the throttle valve 25 is substantially closed), the suction pressure acts in the variable pressure chamber 75 to deflect downwardly the diaphragm 71, against the action of the helical spring 77, and to draw fuel into the fuel pumping chamber 73 above the diaphragm 71. When thereafter the throttle valve 25 is rapidly opened, fuel flows from the fuel pumping chamber 73 above the diaphragm 71 and through the outlet conduit 60 between the ring-shaped well portion 59 of the fuel pumping chamber 73 and the fuel well 33.

Located between the upper end of the conduit 60 and the fuel well 33 is a cap or member 91 which includes an upper cross wall 93 closing the lower end of the fuel well 33, and a downwardly extending skirt 95 defining a downwardly open interior bore 97. The cross wall 93 of the cap member 91 includes a relatively small aperture 99 affording fuel flow from the interior of the bore 97 to the fuel well 33.

Located in the downwardly open bore 97 in the cap member 91 is a one-way outlet check valve 100 including an outlet ball valve or member 101 which operates between a closed position against a valve seat 103 formed at the upper end of the conduit 60 to prevent flow relative to the conduit 60 and an open position spaced above the valve seat 103 to permit fuel out-flow from the outlet conduit 60 incident to the presence of fuel under pressure in the outlet conduit 60. The outlet ball valve member 101 thus moves to the open position in response to fuel pressure in the conduit 60 and moves to the closed position in response to the action of gravity.

Fuel flow to the upper fuel pumping chamber 73 above the diaphragm 71 is afforded incident to increased suction in the lower variable pressure chamber 75 beneath the diaphragm 71 by (see FIG. 2) a one-way inlet check valve 110 which includes an inlet ball valve or member 111 located in a fuel supply or inlet conduit 113 which is formed in the fuel chamber body 51, which, at its lower end, includes an enlarged bore portion 115, and which, at its upper end, includes a reduced size bore portion 117 having a lower end serving as a valve seat 119 against which an inlet ball valve or member 111 is movable between open and closed positions.

More specifically, the inlet ball valve member 111 is located in an upwardly open socket 131 in a socket member 133 which is biased upwardly by a helical spring 135 encircling a lower reduced diameter part of the socket member 133. At its lower end, the spring 135 bears against the retainer plate 67, and, at is upper end, bears against the socket member 133. As a consequence, in the absence of movement of the diaphragm 71 downwardly to enlarge the fuel pumping chamber 73 above the diaphragm 71, the ball valve member 111 is seated against the valve seat 119 to preclude flow in both directions. However, when the diaphragm 71 is flexed downwardly to increase the volume of the fuel pumping chamber 73 above the diaphragm 71 in response to increased suction downstream of the throttle valve 25, the ball valve member 111 moves away from the valve seat 119, thereby permitting in-flow of fuel from the fuel chamber 53 to the fuel pumping chamber 73. When the helical spring 77 acts to upwardly displace the diaphragm 71 (when the increased suction is removed by rapid opening of the throttle valve 25) the fuel in the upper fuel pumping chamber 73 is pressurized to therely press the inlet ball valve member 111 against the valve seat 119 and to lift the outlet ball valve member 101 from the valve seat 103, to thereby supply the fuel well 33 and high speed nozzle 37 with enrichment fuel which is supplied to the air induction passage 15.

Of course, gaskets are employed as desired to prevent leakage of fuel and pressure gas.

Various of the features of the invention are set forth in the following claims.

We claim:

1. A carburetor including a member defining an air induction passage including a downstream portion, an upstream portion, and a venturi located between said downstream portion and said upstream portion, a member defining a fuel chamber, a fuel well extending in said fuel chamber, and communicating with said fuel chamber, a high speed nozzle located in said fuel well and communicating with said venturi, and an enrichment fuel pump including a cover fixed to said fuel chamber defining member, a diaphragm located between said cover and said fuel chamber defining member and defining a fuel pumping chamber and a variable pressure chamber, a duct communicating between said variable pressure chamber and said downstream portion of said air induction passage downstream of said throttle valve, an inlet conduit communicating between said fuel chamber and said fuel pumping chamber and including an inlet check valve permitting in-flow into said fuel pumping chamber and preventing out-flow therefrom and comprising an inlet valve seat on said inlet conduit, an inlet ball valve member moveable relative to said inlet valve seat between open and closed positions, and a retainer plate located between said diaphragm and said fuel chamber defining member and including therein an aperture, and a spring bearing between said inlet ball valve member and said retainer plate to bias said inlet check valve into said closed position, and an outlet conduit communicating between said fuel pumping chamber and said fuel well and including an outlet check valve permitting out-flow from said fuel pumping chamber and preventing in-flow thereto.

2. A carburetor in accordance with claim 1 wherein said inlet check valve further includes a socket member located between said inlet ball valve member and said spring and including a socket portion partially enclosing said inlet ball valve member.

3. A carburetor in accordance with claim 1 wherein said outlet check valve includes an outlet valve seat on said outlet conduit and an outlet ball valve member moveable relative to said outlet valve seat between open and closed positions.

4. A carburetor in accordance with claim 3 wherein said fuel well includes an open lower end, and wherein said carburetor further includes a member located between said fuel well and said outlet conduit and including a cross wall closing said lower end of said fuel well, and a downwardly depending skirt enclosing said outlet ball valve member.

5. A carburetor including a member defining an air induction passage including a downstream portion, an upstream portion, and a venturi located between said downstream portion and said upstream portion, a member defining a fuel chamber, a fuel well located in said air induction passage defining member, extending in said fuel chamber, communicating with said fuel chamber, and including an open lower end, a high speed nozzle located in said fuel well and communicating with said venturi, and an enrichment fuel pump including a cover fixed to said fuel chamber defining member, a diaphragm located between said cover and said fuel chamber defining member and defining a fuel pumping chamber and a variable pressure chamber, a retainer plate located between said diaphragm and said fuel chamber defining member and including therein an aperture, a duct communicating between said variable pressure chamber and said downstream portion of said air induction passage downstream of said throttle valve, an inlet conduit communicating between said fuel chamber and said fuel pumping chamber and including an inlet check valve permitting in-flow into said fuel pumping chamber, preventing out-flow therefrom, and including an inlet valve seat on said inlet conduit, and an inlet ball valve member moveable relative to said inlet valve seat between open and closed positions, a socket member located between said inlet ball valve member and said retainer plate and including a socket portion partially enclosing said inlet ball valve member, and a spring bearing between said socket member and said retainer plate to bias said socket member so as to locate said inlet ball valve member in said closed position, an outlet conduit communicating between said fuel pumping chamber and said fuel well and including an outlet check valve including an outlet valve seat on said outlet conduit and an outlet ball valve member moveable relative to said outlet valve seat between open and closed positions so as to permit outflow from said fuel pumping chamber and so as to prevent in-flow thereto, and a member located between said fuel well and said outlet conduit and including a cross wall closing said lower end of said fuel well, and a downwardly depending skirt enclosing said outlet ball valve member.

* * * * *